US010060078B2

(12) United States Patent
Vargas et al.

(10) Patent No.: US 10,060,078 B2
(45) Date of Patent: Aug. 28, 2018

(54) STONEBLOWER FOR RAIL APPLICATIONS

(71) Applicant: HARSCO TECHNOLOGIES LLC, Fairmont, MN (US)

(72) Inventors: Victor Vargas, West Columbia, SC (US); Chris Larsen, West Columbia, SC (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 124 days.

(21) Appl. No.: 15/276,076

(22) Filed: Sep. 26, 2016

(65) Prior Publication Data

US 2017/0096779 A1 Apr. 6, 2017

Related U.S. Application Data

(60) Provisional application No. 62/235,648, filed on Oct. 1, 2015.

(51) Int. Cl.

| | |
|---|---|
| ***E01B 27/02*** | (2006.01) |
| ***E01B 29/04*** | (2006.01) |
| ***E01B 27/18*** | (2006.01) |

(52) U.S. Cl.

CPC ..... *E01B 27/022* (2013.01); *E01B 27/18* (2013.01); *E01B 29/04* (2013.01); *E01B 2203/062* (2013.01); *E01B 2203/08* (2013.01); *E01B 2203/10* (2013.01)

(58) Field of Classification Search

CPC ..... E01B 27/02; E01B 27/18; E01B 27/12; E01B 35/00; E01B 1/00; F04B 23/08; F04B 23/14

See application file for complete search history.

(56) References Cited

U.S. PATENT DOCUMENTS

| | | | | |
|---|---|---|---|---|
| 4,386,570 | A * | 6/1983 | Waters | E01B 27/18 104/11 |
| 5,577,446 | A * | 11/1996 | Perry | E01B 27/18 104/11 |
| 5,584,641 | A * | 12/1996 | Hansen | B65G 33/24 104/2 |
| 5,605,099 | A * | 2/1997 | Sroka | E01B 35/08 104/2 |
| 5,865,592 | A | 2/1999 | Hansen | |
| 6,334,396 | B2 | 1/2002 | Perry et al. | |
| 7,226,274 | B1 * | 6/2007 | Asplin | F04B 15/023 417/203 |
| 2001/0042487 | A1 * | 11/2001 | Perry | E01B 27/18 104/2 |
| 2017/0096779 | A1 * | 4/2017 | Vargas | E01B 27/022 |

OTHER PUBLICATIONS

International search report and written opinion of the international searching authority for co-pending PCT application No. PCT/US2016/053732 dated Jan. 2, 2017.

* cited by examiner

*Primary Examiner* — Jason C Smith
(74) *Attorney, Agent, or Firm* — Baker & McKenzie LLP

(57) ABSTRACT

The present disclosure generally relates to a railroad chassis vehicle having independently operable workheads for carrying out rail maintenance operations on non-uniform sections of railroad tracks. Related methods of operation of the railroad chassis and associated maintenance of ballast beds underlying railroad tracks are also described.

17 Claims, 9 Drawing Sheets

STONEBLOWER FOR RAIL APPLICATIONS

CROSS-REFERENCE TO RELATED APPLICATION

This application claims priority to U.S. Provisional Patent Application No. 62/235,648 filed on Oct. 1, 2015, the disclosure of which is hereby incorporated by reference in entirety.

BACKGROUND

Railroads are typically constructed to include a pair of elongated, substantially parallel rails, which are coupled to a plurality of laterally extending rail ties. The rail ties are disposed on a ballast bed of hard particulate material such as gravel and are used to support the rails. Over time, normal wear and tear on the railroad may cause the rails to deviate from a desired profile based on movement of the underlying ballast, and as such voids or gaps under the rail ties may appear.

The traditional method of fixing voids that appeared under rail ties was very labor and time intensive, as it required measurement of the voids under each individual rail tie, manually lifting the rail ties, and then spreading a pre-measured quantity of ballast under the rail ties to raise the rails. In the 1970s, British Rail developed a mechanization of the traditional method by modifying a tamper and installing a system for distributing ballast under the rail tie with blasts of compressed air, creating the first stoneblower.

Modern stoneblowers are typically wheeled cars that comprise a track lifting device, a supply of crushed ballast rock, a source of compressed air, and a number of workheads. Each workhead carries a pair of blowing tubes. In operation, the track lifting device raises the track rails and the underlying rail ties to which the rails are secured. The workhead forces the blowing tubes into the ballast adjacent the raised rail ties with each pair of blowing tubes straddling a track rail. Stone is then blown through the blowing tubes into the voids beneath the raised rail ties. The workhead withdraws the blowing tubes and the track rail and rail ties are lowered. The stoneblower then advances to the next set of rail ties and repeats this procedure.

Modern stoneblowers are designed to restore a track's vertical and lateral alignment to an accuracy of 1.0 mm without disturbing the pre-existing compacted ballast layer. Vehicle bogies allow stoneblowers to measure a loaded track profile, and therefore measure the voids in the ballast under each rail tie. Computers then calculate the quantity of ballast to be "blown" under each rail tie, thus minimizing stone usage based on the track category or speed limit.

Compared with tamping, stoneblowers advantageously can be used on high speed track lines, treat only the areas of the track that need treatment, and reduce ballast damage. Further, after stoneblowing, the track does not become more rigid because the stoneblower only treats areas that need treatment, while the majority of the rail ties are supported on the original ballast and railroad bed. In addition, a new rock supplier is not needed to use a stoneblower for track maintenance. The injected ballast often comes from the same quarries and has the same attrition values as normal ballast. Additionally, using small, crushed stones as ballast causes less damage to the underside of the rail ties because the small stone is less likely to fail under heavy axle load based on increased surface area.

Current stoneblowers have some drawbacks, however, based on the current design incorporating pairs of parallel blowing tubes. For example, modern stoneblowers cannot efficiently blow ballast under non-uniform sections of rails, such as at railroad frogs or crossings, because the pairs of blowing tubes are only configured to have blowing tubes on each side of a rail and/or on each side of a rail tie, but they cannot blow ballast directly under the frog and/or under the rail tie area directly under the frog. However, in the continually changing world of track maintenance, it is essential that rail companies be able to provide quality track maintenance and alignment equipment that can service all sections of rail, not just uniform sections of rail. Moreover, conventional stoneblowers are large vehicles that are expensive to manufacture, deploy and operate. Smaller stoneblower machines, including those that can be deployed to work small areas of rail, such as frogs, are needed. Therefore, an improved stoneblower is desired.

BRIEF SUMMARY

The present disclosure generally relates to an improved stoneblower system comprising a railroad chassis for performing ballast maintenance on sections of non-uniform railroad track, such as railroad frogs or other intersections. The railroad chassis includes a plurality of workheads that are independently operable (e.g., movable). Each of the workheads includes one or more blowing tubes for dispensing ballast stones into a bed of ballast stones underlying rail ties of a railroad track. The one or more blowing tubes may be lowered into the bed of ballast stone so that new ballast stone may be dispensed into cavities in the bed of ballast stone below the rail ties. Dispensing new ballast stone into the bed of ballast stone raises the height of the bed of ballast stone, thereby raising the height of the overlying rail ties and rails of the railroad tracks. In this manner, alignment of the railroad tracks may be improved and/or maintained. The blowing tubes may similarly be independently operable with respect to the workheads (e.g., rotatable with respect to the workheads) so that new ballast may be accurately dispensed in difficult-to-reach locations of the non-uniform railroad track. Various hardware elements may be used to control positioning of the workheads and the blowing tubes. Additionally, a computing system may be utilized to collect and analyze measurements associated with the railroad track to ensure appropriate amounts of ballast stone are dispensed in particular locations. Related methods for operating the railroad chassis are also described.

BRIEF DESCRIPTION OF THE DRAWINGS

Reference is now made to the following descriptions taken in conjunction with the accompanying drawings.

DETAILED DESCRIPTION

Various embodiments of an improved stoneblower are described according to the present disclosure. It is to be understood, however, that the following explanation is merely exemplary in describing the devices and methods of the present disclosure. Accordingly, several modifications, changes, and substitutions are contemplated.

Figure 1:
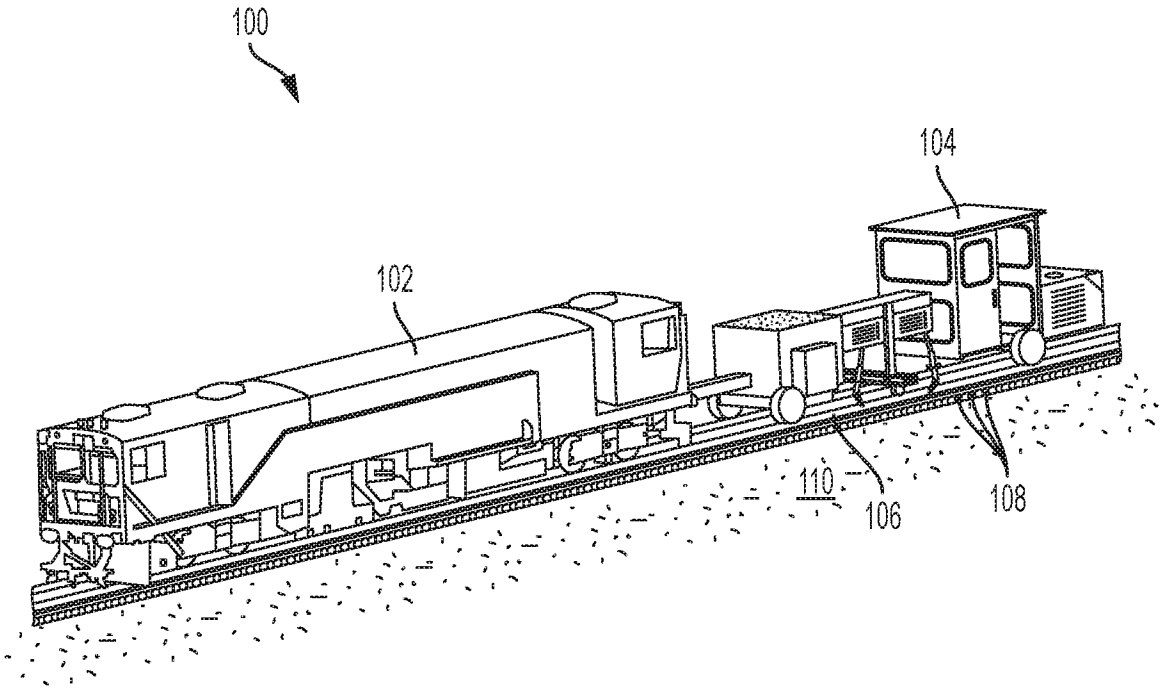
FIG. 1 illustrates a perspective view of an exemplary stoneblower system according to the present disclosure.

In an embodiment, and as shown in FIG. 1, an improved stoneblower system 100 may comprise a rail maintenance vehicle 102 and a railroad chassis 104. In some embodiments, the railroad chassis 104 may be towed behind the rail maintenance vehicle 102 as the rail maintenance vehicle 102 propels itself along rails 106 of a railroad track. In other embodiments, the railroad chassis 104 may be self propelled and thus may include an engine 107 (e.g., a propulsion system and/or operating system) for propelling the railroad chassis 104 along the rails 106 of the railroad track. In still other embodiments, the railroad chassis 104 may be operated as a drone vehicle with no on-board personnel. In further embodiments, the railroad chassis 104 may take the form of a road-rail chassis or hy-rail vehicle, which may be operated on both roads and rail. The rail maintenance vehicle 102 and/or the railroad chassis 104 of the stoneblower system 100 may include a plurality of wheels for engaging and moving along a top surface of the rails 106.

As described throughout, the railroad track may include a pair of elongated, substantially parallel rails 106, which may be coupled to a plurality of laterally extending rail ties 108. In some embodiments, a top surface of each rail tie 108 may be coupled to a bottom surface of the rails 106. The rail ties 108 may be disposed on a ballast bed 110 of hard particulate material such as gravel (e.g., ballast, rocks, and/or the like) and may be used to support the rails 106.

Figure 2:
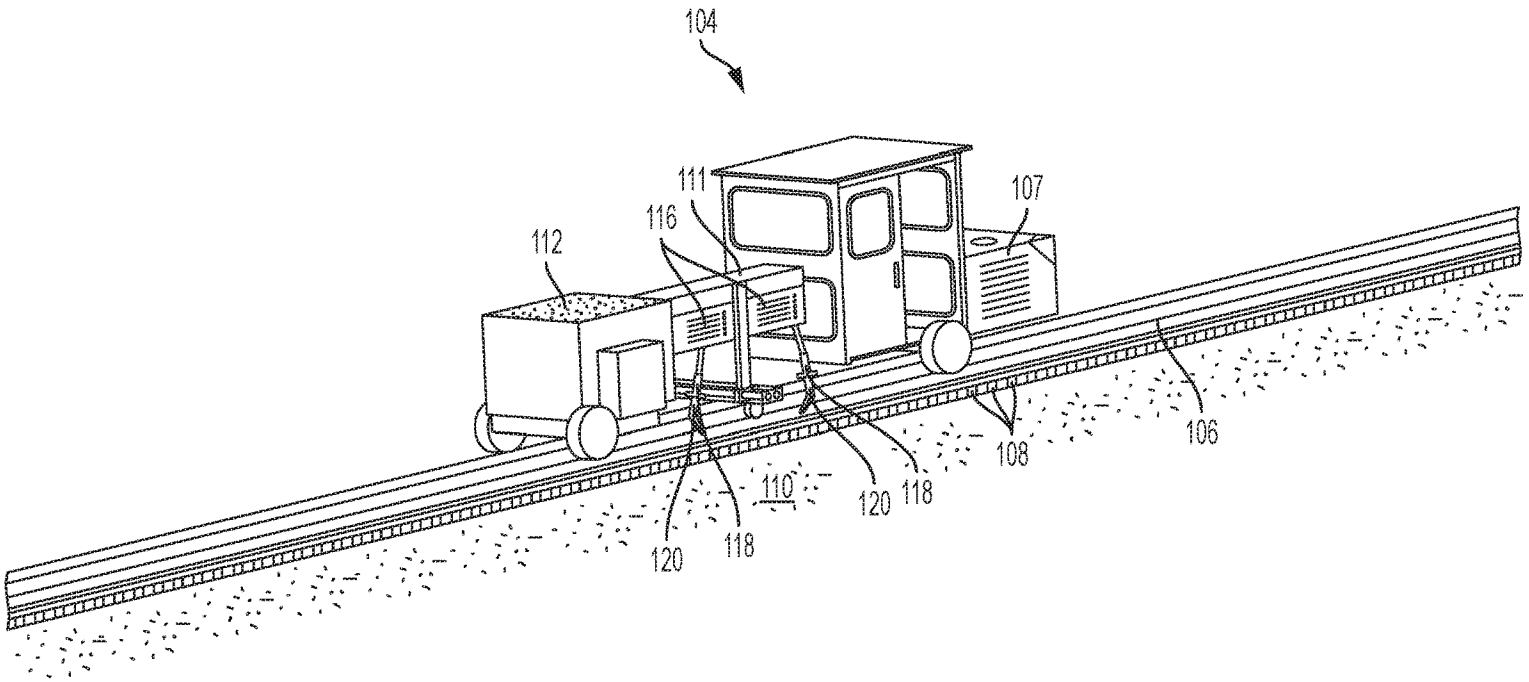
FIG. 2 illustrates a perspective view of an exemplary railroad chassis of the stoneblower system of FIG. 1.

FIG. 2 illustrates a more detailed view of the railroad chassis 104 of FIG. 1. In some embodiments, the railroad chassis 104 may include a wheeled car comprising a ballast supply 112, a track lifting device (not shown), at least one source of compressed air 116 (e.g., air compressor), and a plurality of workheads 118. The railroad chassis 104 also may include various framing elements (e.g., frame 111) for coupling with elements described herein, as well as an operator cab.

In some embodiments, ballast stones may include crushed rock, gravel, and/or other small, hard particulate material. Ballast stones may be held in the ballast supply 112 (e.g., a containing device, a hopper, a bin, and/or the like) of the railroad chassis 104. In some embodiments, the ballast supply 112 may include a dispenser and/or conveyor belt for transporting and/or distributing ballast stones to various workheads 118 of the railroad chassis 104. In some embodiments, this dispenser and/or conveyor belt may be mechanized and/or controlled by a computing system. Additionally, the ballast supply 112 may include one or more sensors for determining an amount (e.g., a volume, a weight, and/or the like) of ballast stones remaining in the ballast supply 112 and/or an amount of ballast stones to be dispensed to (and/or dispensed by) one or more workheads 118. In some embodiments, determining an amount of ballast stones remaining in the ballast supply 112 may initiate, by the computing system, generation of an automated request for refilling the ballast supply 112 with a predetermined amount of ballast stones. In other embodiments, determining an amount of ballast stones to be dispensed to one or more workheads 118 may be performed by the computing system and/or may occur in response to a measurement associated with the ballast bed 110 as described in more detail below.

Figure 3:
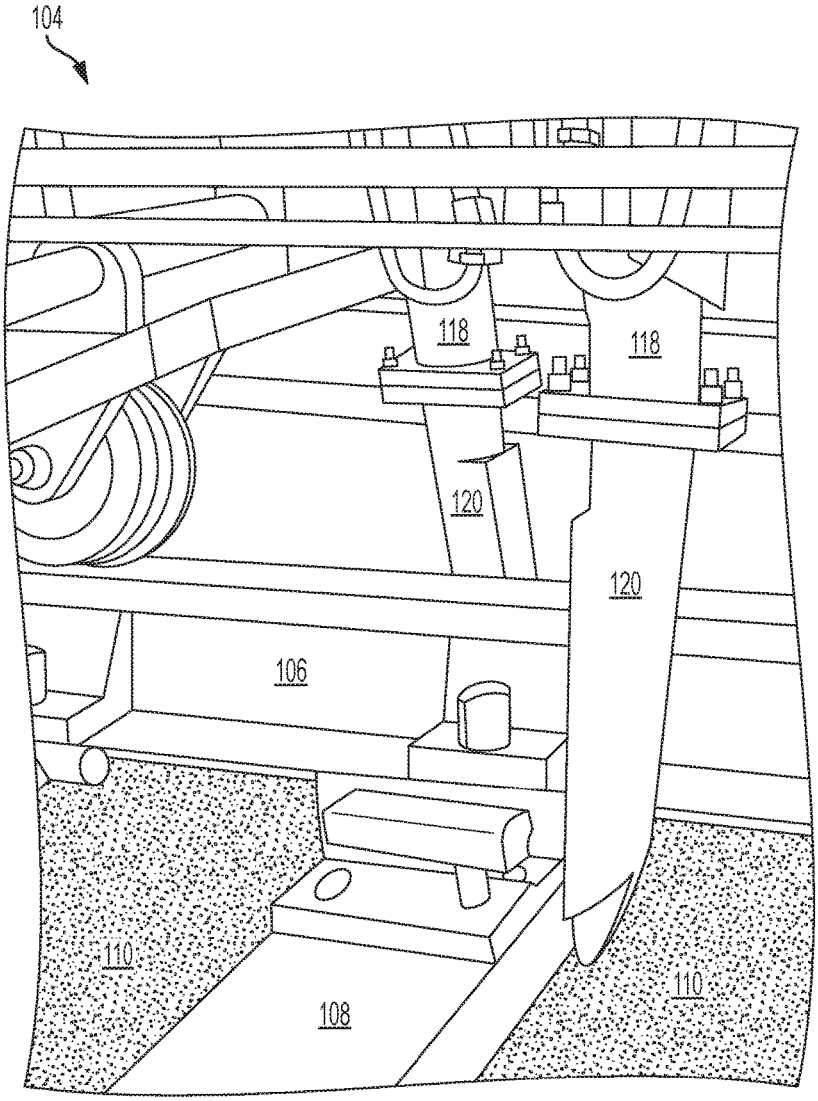
FIG. 3 illustrates a perspective view of a workhead and associated blowing tube associated with the associated with the railroad chassis of FIG. 2.
Figure 4:
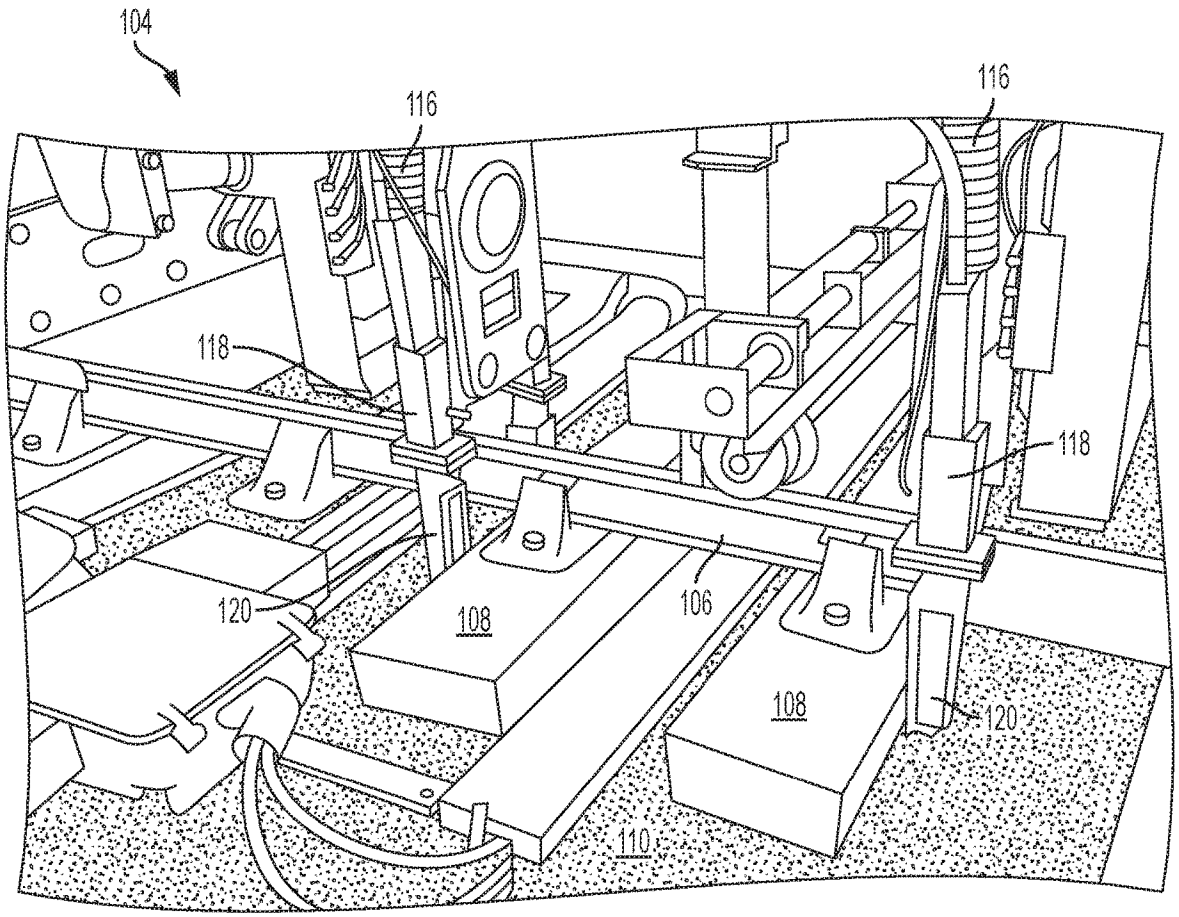
FIG. 4 illustrates a perspective view of a track reference device associated with the railroad chassis of FIG. 2.

In an embodiment, and as shown in FIG. 3, each workhead 118 may be configured to disperse and/or distribute ballast stones through blowing tubes 120. A lower end of each workhead 118 may comprise one or more blowing tubes 120. The blowing tubes 120 may be arranged on a workhead 118 as a single blowing tube 120, a pair of blowing tubes 120, and/or any other arrangement of blowing tubes 120.

Each blowing tube 120 may comprise a vertically elongated opening through which ballast stone is distributed. For example, during operation, a blowing tube 120 may be lowered into the ballast bed 110 so that ballast stones may be blown (e.g., inserted and/or injected) into gaps (e.g., voids, cavities, and/or the like) in the ballast bed 110 beneath rail ties 108. This insertion of ballast stones into the ballast bed 110 may raise the rail ties 108 to a desired height so as to stabilize the rail ties 108 and increase alignment of the rails 106.

Each blowing tube 120 may further be configured to be independently inserted into the ballast bed 110. For example, each workhead 118 (and thus each blowing tube 120) may independently pivot, move, and/or traverse laterally relative to a rail 106 and/or a rail tie 108. In this manner, ballast stones may be distributed in the ballast bed 110 at precise angles and/or locations. This is particularly advantageous at intricate track intersections and/or switches in the railroad track.

Additionally, in some embodiments, a blowing tube 120 may be independently operable (e.g., movable, adjustable, and/or the like) relative to its associated workhead 118. For example, the blowing tube 120 may be independently rotatable, angularly adjustable, and/or extendable relative to the workhead 118 to which it is coupled. In some embodiments, a housing may be coupled to a distal end of the workhead 118 to accommodate insertion of the blowing tube 120 into the housing. A motor, or other activation device may be provided in the housing for causing rotation of the blowing tube 120 relative to the workhead 118 based on instructions received from a computing system associated with the rail vehicle 102. The housing may contain one or more thrust bearings that accommodate rotation of the blowing tube 120 and ensure that the motor does not receive the thrust. Further, an anti-rotational pin may be deployed to lock the blowing tube 120 in place once it rotates to the desired position. Of course, the aforementioned description of the rotation mechanism for the blowing tube 120 is merely exemplary, and other embodiments are contemplated so long as the blowing tube 120 is independently rotatable relative to the workhead 118.

Figure 7:
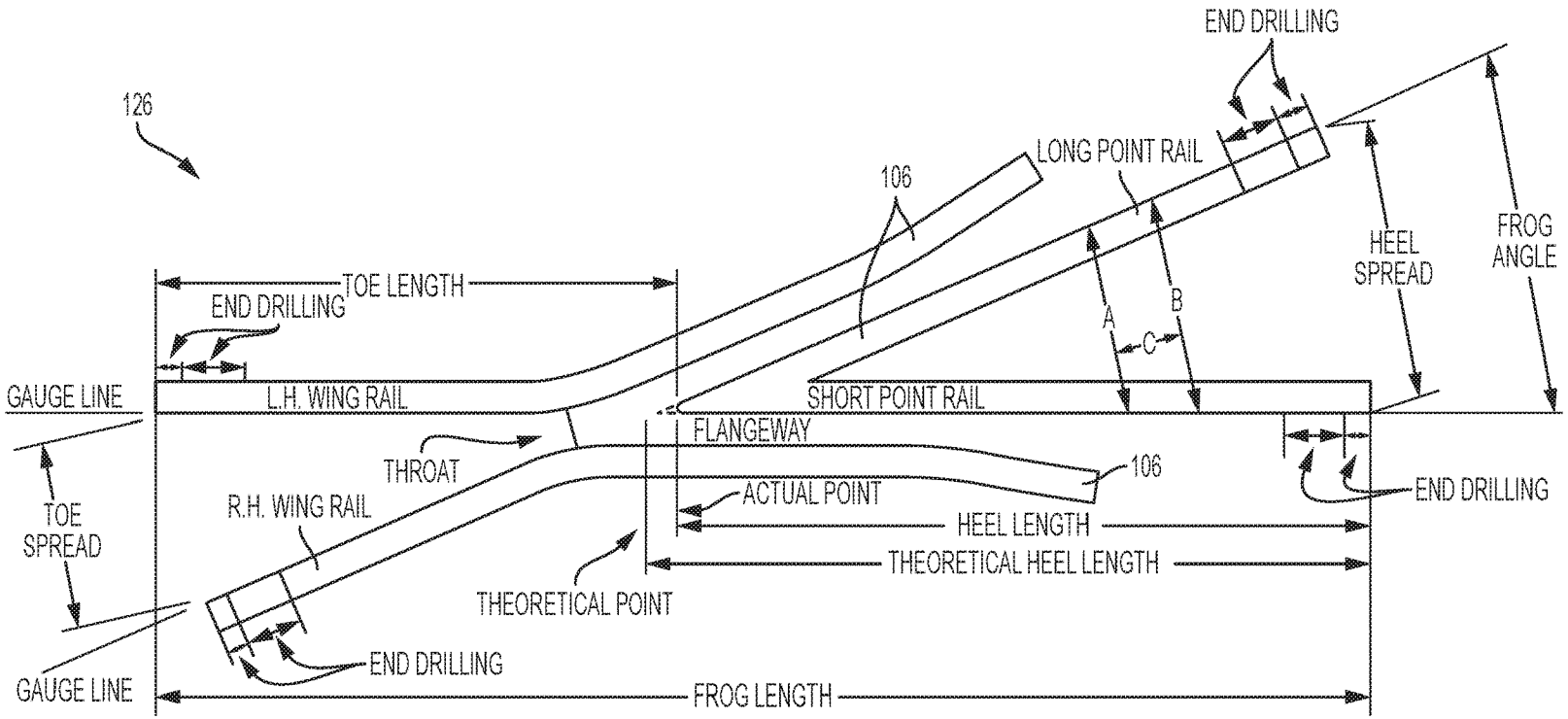
FIG. 7 illustrates a top view of an exemplary railroad frog intersection according to the present disclosure.

In some embodiments, the blowing tubes 120 may be capable of rotating about a vertical axis specifically designed to match a curvature of one or more non-uniform rail locations, such as at a railroad frog track intersection (e.g., railroad frog 126 of FIG. 7). By allowing the blowing tubes 120 to rotate about the vertical axis, the elongated opening in each blowing tube 120 that deposits the ballast may face a side of the rail 106 in order to deliver ballast stone under a rail tie 108 and/or another track section. In some embodiments, the blowing tubes 120 may be curved.

During operation, the track lifting device may be utilized to lift a portion of the rails 106 and/or rail ties 108 so that ballast stones may be blown into the ballast bed 110 underlying the rail ties 108. The track lifting device may lift the rail 106 and/or underlying rail ties 108 to a predetermined distance above of the ballast bed 110 so that a desired amount of ballast stones may be inserted underneath the lifted rail ties 108. In some embodiments, the movements of the track lifting device may be controlled by the computing system as described herein.

Also during operation, air from an air compressor 116 associated with the workhead 118 may be utilized to insert and/or inject ballast stones through the blowing tube 120 and into the ballast bed 110. In some embodiments, each workhead 118 may include an air compressor 116. In other embodiments, workheads 118 may share a common air compressor 116 and/or may comprise multiple air compressors 118. The computing system may determine an amount of air to be blown into each workhead 118 and through the blowing tube 120 as described in more detail below.

Figure 5:
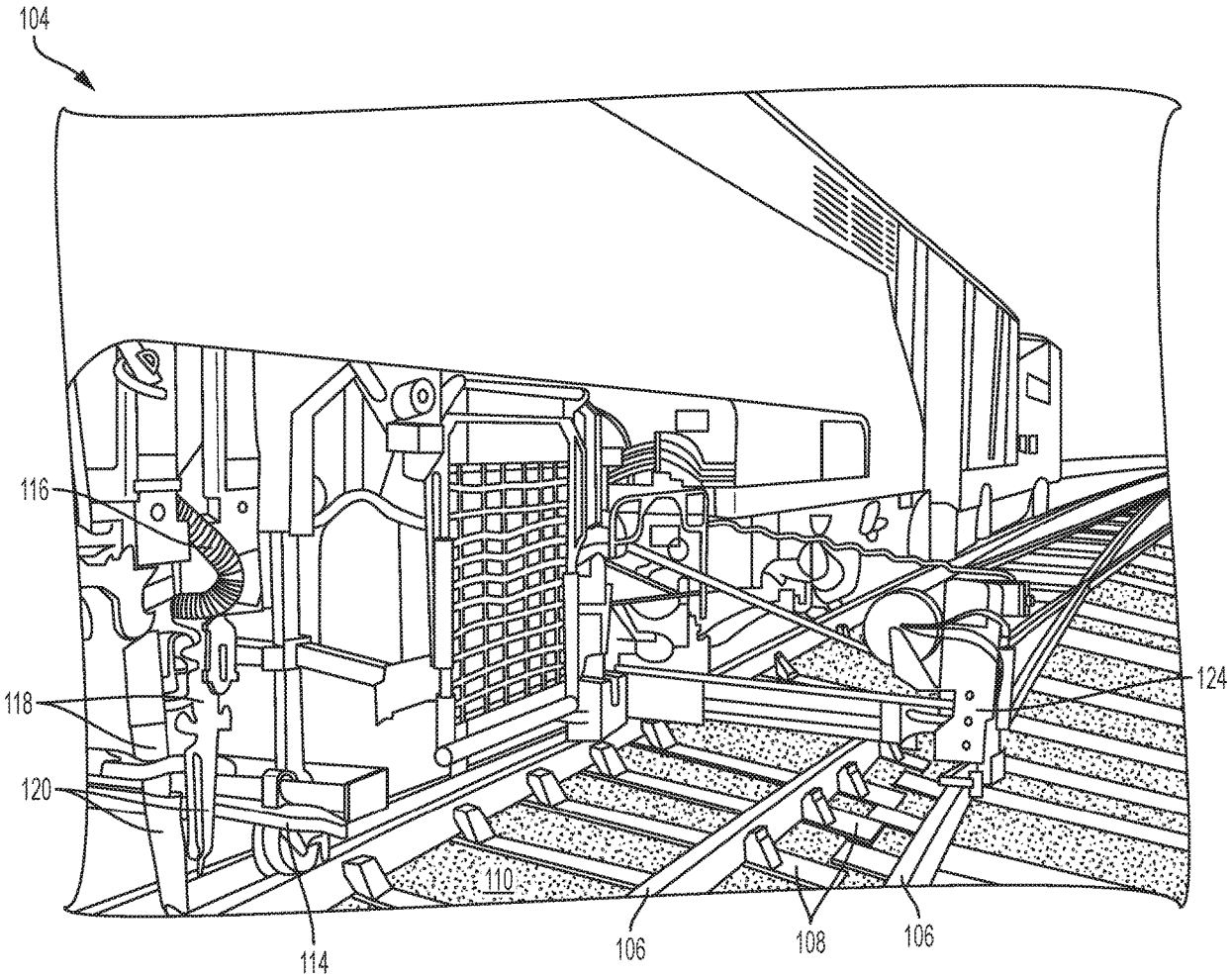
FIG. 5 illustrates a perspective view of a third point lifting arm associated with the railroad chassis of FIG. 2.

In an embodiment, and as depicted in FIG. 5, the railroad chassis 104 may further comprise one or more third point lifting arms 124 operable to enable the blowing of ballast stones under portions of railroad tracks that are not uniform, such as railroad switches and/or crossing panels of adjacent railroad tracks, railroad frog track intersections, and/or the like. For example, a third point lifting arm 124 may be configured to move a workhead 118, and in turn, an associated blowing tube 120, laterally relative to the railroad chassis 104. In this manner, the workhead 118 and the associated blowing tube 120 may move outwardly from the railroad chassis 104 along the third point lifting arm 124 so that the blowing tube 120 may be lowered into the ballast bed 110 underneath a rail tie 108 of an adjacent rail 106 (e.g., a rail 106 adjacent to the rail 106 on which the railroad chassis 104 is positioned).

The third point lifting arm 124 may extend outwardly from the railroad chassis 104 using a hydraulic system. The third point lifting arm 124 may also be foldable and/or pivotable in relation to the railroad chassis 104.

In some embodiments, the third point lifting arm 124 may be operated by a maintenance professional located inside the railroad chassis 104 and/or by a second maintenance professional located outside the railroad chassis 104. The workhead 118 may be configured to move a predetermined distance along the third point lifting arm 124 so that the workhead 118 (and thus the blowing tube 120) is positioned as desired near a rail tie 108 of an adjacent rail 106 and/or track section. Movements of the third point lifting arm 124 and/or the workhead 118 along the third point lifting arm 124 may also be controlled by the computing system as described herein.

Figure 6:
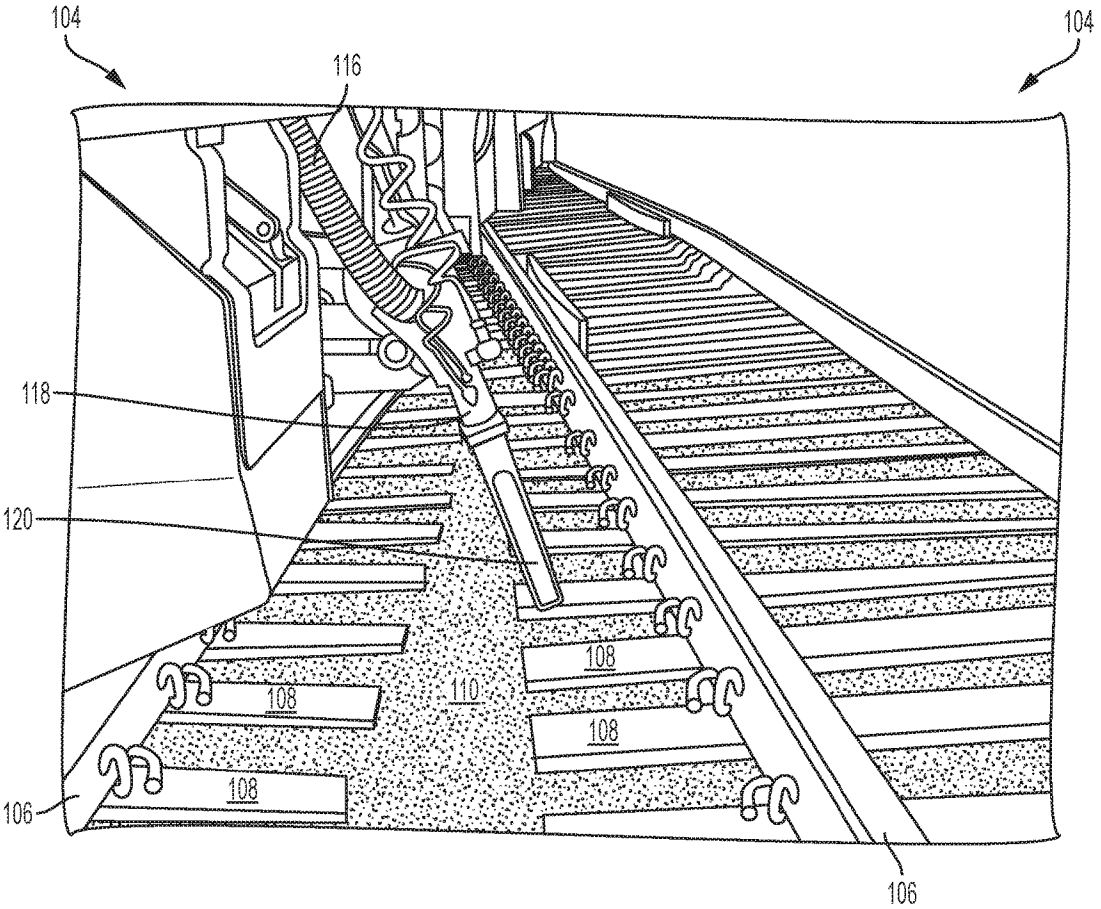
FIG. 6 illustrates a perspective view of a railroad chassis associated with the railroad stoneblower system of FIG. 1.

In an embodiment, and as depicted in FIG. 6, the railroad chassis 104 may be utilized at a rail switch. As shown in FIG. 6, the blowing tube 120 may be deployed at an angle relative to the vertical axis of the rail 106. Importantly, utilizing multiple workheads 118 on the railroad chassis 104 and/or third point lifting arms 124 as described above may enable a railroad maintenance crew to blow ballast stones under rail ties 108 of rails 106 at non-uniform locations and angles, thereby raising the rails 106 at locations previously unserviceable by standard stoneblowers.

As shown in FIG. 7, a railroad frog 126 may include a railroad track structure that is used at an intersection of two running rails 106 to provide support for railcar wheels and passageways for wheel flanges, thus permitting wheels on either rail 106 to cross over the rails 106. On a rail wheel, the flange may be the inside rim which projects below the tread. Each railroad frog 126 may have about fifteen rail ties 108 under the rails 106 of the railroad frog 126, and as such, tamping equipment and current stoneblowers cannot adequately maintain a railroad line at the railroad frog 126 because of the non-uniform nature of the rails 106 at the railroad frog 126. Advantageously, the disclosed improved stoneblower 100 is operable to blow ballast stones under rail ties 108 of the rails 106 of the railroad frog 126, as well as many other non-uniform sections of rail 106.

Figure 8:
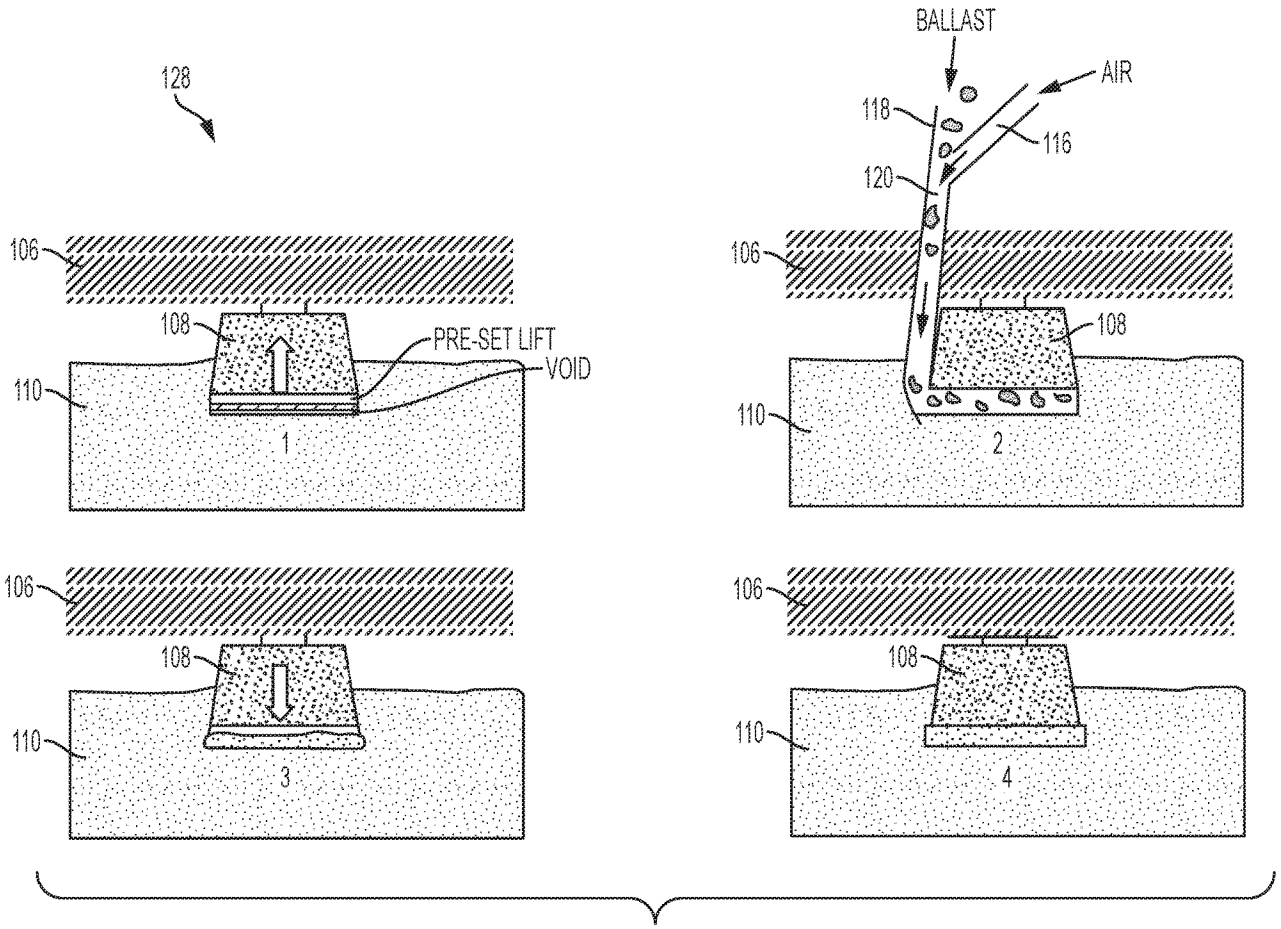
FIG. 8 illustrates a cross-sectional side view of an exemplary stoneblowing process according to the present disclosure.

In operation, each independent workhead 118 may work in a similar manner as the ballast stone depositing process 128 depicted in FIG. 8. In a first step, the railroad chassis 104 may move along the rails 106 to a desired position on a particular section of railroad track. While moving along the rails 106, one or more sensors associated with the railroad chassis 104 may collect track profile data associated with the rails 106. These sensors may measure a height, a width, an orientation, a shape, a contour, an angle, a condition, and/or other factors associated with the rails 106.

A track design computer (e.g., the computing system as described herein) associated with the railroad chassis 104 and in communication with the one or more sensors may generate a track profile of the rails 106 along the particular section of rail 106. Based on the generated track profile, the computer system may calculate an amount of ballast stone required to be blown into the ballast bed 110 underneath one or more rail tie(s) 108 along the particular section of the rail 106 to achieve a desired or optimum track profile.

The computing system may then, based on the determined amount of ballast stone to be blown into the ballast bed 110, determine a height to which the rails 106 and/or the rail ties 108 need to be raised so that the determined amount of ballast stone may be blown underneath the rail ties 108. The computing system may instruct the track lifting device to lift the rail(s) 106 to at least the predetermined height so that adequate space in the ballast bed 110 is present (e.g., see step 1 of FIG. 8).

The computing system may also, based on the determined amount of the ballast stone to be blown into the ballast bed 110, determine an amount of ballast stone held in the ballast supply 112 to be distributed to the one or more workheads 118 for injection into the ballast bed 110. The computing system may instruct the ballast supply 112 to distribute the determined amount of ballast stone to the one or more workheads 118. In some embodiments, the determined amount of ballast stone may be distributed to the one or more workheads 118 according to the computer system instructions continuously during the stoneblowing process and/or at a time prior to stoneblowing.

The computing system may further, based on the determined amount of the ballast stone to be blown into the ballast bed 110, determine an amount of compressed air to be blown by the air compressor(s) 116 for injecting the determined amount of ballast stone into the ballast bed 110. The computing system may instruct the air compressor(s) 116 to distribute the determined amount of compressed air stone to the one or more workheads 118 and/or the blowing tubes 120.

The computing system may additionally, based on the determined amount of the ballast stone to be blown into the ballast bed 110, determine a position of the one or more workheads 118 for optimally blowing the ballast stones into desired locations in the ballast bed 110. In this manner, the computing system may instruct various movements and/or adjustments of at least one of the one or more workheads 118, the associated blowing tubes 120, and the third point lifting arm 124 so that the workheads 118, and importantly the blowing tubes, are accurately and independently positioned for dispensing the ballast stones into the ballast bed 110 as desired. For example, the one or more workheads 118 (and thus the associated blowing tubes 120) may be independently lowered (e.g., inserted) into the ballast bed 110 at a predetermined location along the rail 106 and at a calculated angle relative to the rail 106 and/or rail tie 108. Once inserted into the ballast bed 110, the blowing tubes 120 may be rotated and/or adjusted with respect to the workheads 118.

The computing system may then instruct the one or more workheads 118 to independently blow the determined amount of compressed air and ballast stone through the blowing tubes 120 so that it is injected into the ballast bed 110 at one or more desired locations (e.g., see step 2 of FIG. 8). For example, ballast stones may be blown underneath the rail tie 108 associated with the lifted rail 106, thereby accumulating new ballast stones in the ballast bed 110 under the rail(s) 106 and/or rail tie(s) 108 (e.g., see step 3 of FIG. 8).

Once the determined amount of ballast stones is injected into the ballast bed, the computer system may instruct the track lifting device to lower the rails 106 and/or the rail ties 108 so that the rail ties 108 rest on the ballast bed 110 (e.g., see step 4 of FIG. 8). Because of the ballast stones being injected into the ballast bed 110 to raise the ballast bed 110, the rail(s) 106 and/or rail tie(s) 108 may similarly be raised, thereby leveling the rails 106 to a desired height and/or alignment (e.g., track profile). The railroad chassis 104 may then move along to another section of the rails and repeat the aforementioned stoneblowing process.

Advantageously, the improved stoneblower system 100 described herein may be especially helpful at locations where two rails merge or intersect, such as at a railroad frog 126 and/or other non-uniform sections of railroad tracks. In addition, by allowing each workhead 118 (and therefore each blowing tube 120) to move, pivot, and/or be inserted independently, the railroad maintenance crews may be enabled to blow ballast stones under non-uniform sections of rails 106, such as at railroad frogs 126 and/or railroad crossings. By allowing maintenance crews to raise rail ties 108 supporting these non-uniform sections of rails 106 by executing the aforementioned stoneblowing process, railroad frogs 126 and other crossings may have extended lifespans. For example, the rail ties 106 of these crossings may be raised to uniform heights at these locations by adjusting the height of the underlying ballast bed 110, thereby reducing the wear and tear on the rails 106.

Figure 9:
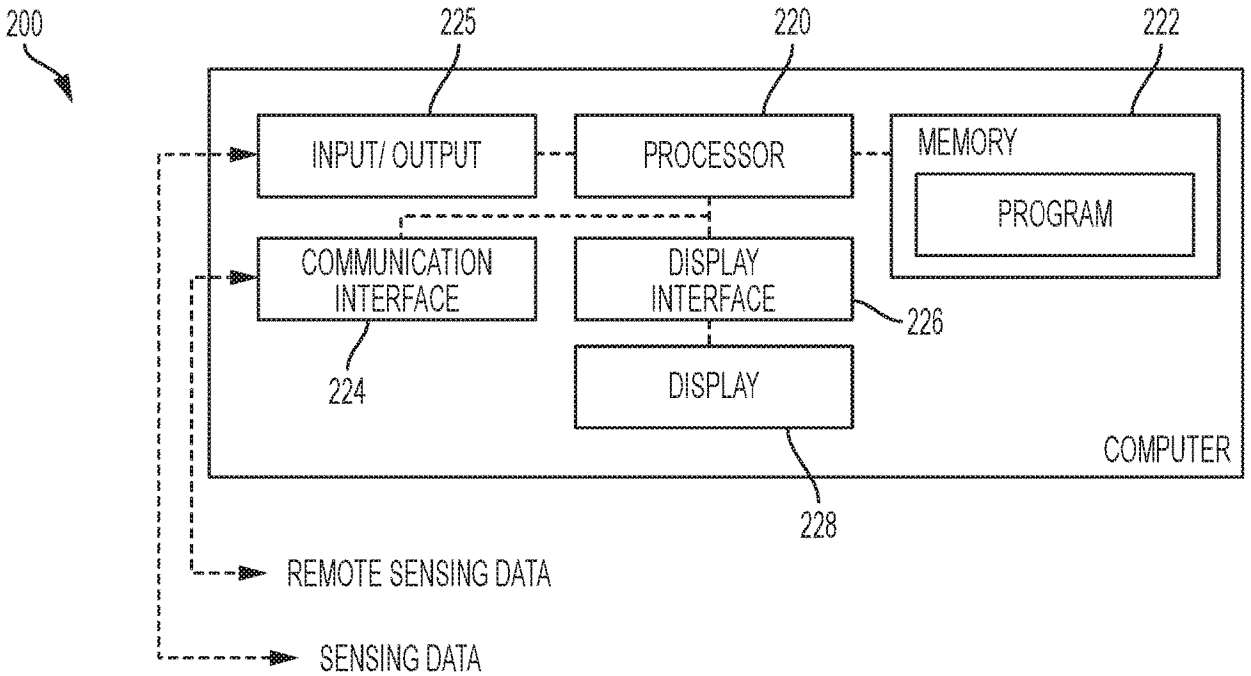
FIG. 9 illustrates a computing system for carrying out processes described herein.

Referring to FIG. 9, the computing system may take the form of a computer or data processing system 200 that includes a processor 220 configured to execute at least one program stored in memory 222 for the purposes of performing one or more of the processes disclosed herein. The processor 220 may be coupled to a communication interface 224 to receive remote sensing data as well as transmit instructions to receivers distributed throughout the rail vehicle 102 and/or chassis 104. The processor 220 may also receive and transmit data via an input/output block 225. In addition to storing instructions for the program, the memory may store preliminary, intermediate and final datasets involved in techniques that are described herein. Among its other features, the data processing system 200 may include a display interface 226 and a display 228 that displays the various data that is generated as described herein. It will be appreciated that the data processing system 200 shown in FIG. 9 is merely exemplary in nature and is not limiting of the systems and methods described herein.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A railroad chassis comprising:

a supply of ballast stones disposed on the railroad chassis;

a plurality of workheads coupled to the railroad chassis, each workhead being independently operable and capable of receiving ballast stones from the supply of ballast stones; and at least one air compressor coupled to the railroad chassis and capable of blowing ballast stones through one or more of the workheads to dispense ballast stones into a bed of ballast stones underlying a railroad track;

wherein each workhead comprises a blowing tube configured to be inserted into the bed of ballast stones for dispensing ballast stones, the blowing tube being coupled to the workhead via a housing, and wherein a motor is disposed within the housing and is configured to rotate the blowing tube relative to the workhead based on a signal received from a computing system associated with the railroad chassis.

2. The railroad chassis according to claim 1, wherein each of the one or more blowing tubes comprises an opening through which compressed air from the at least one air compressor and ballast stones from the supply of ballast stones are blown.

3. The railroad chassis according to claim 1, wherein the blowing tube is curved.

4. The railroad chassis according to claim 1, further comprising a dispenser for distributing ballast stones from the supply of ballast stones to the plurality of workheads.

5. The railroad chassis according to claim 1, further comprising an independent cylinder for controlling movement of at least one workhead of the plurality of workheads.

6. The railroad chassis according to claim 1, further comprising a third point lifting arm, wherein at least one workhead of the plurality of workheads is operable to translate along the third point lifting arm.

7. The railroad chassis according to claim 1, wherein the computing system further controls at least one of the ballast supply, the air compressor, and the one or more workheads, wherein the computing system comprises one or more sensors for collecting track profile data associated with a railroad track.

8. The railroad chassis according to claim 1, wherein the railroad chassis is operable to be driven on road and rail.

9. A method comprising:

providing a railroad chassis on a railroad track, wherein the railroad chassis is operable to move along rails of the railroad track;

determining, using a computing system associated with the railroad chassis, an amount of ballast stones to be dispensed into a bed of ballast stones underlying a rail tie of the railroad track at a first location to achieve an optimal height of the rails at the first location;

providing a plurality of workheads coupled to the railroad chassis, each workhead having a blowing tube coupled thereto;

independently positioning one or more of the plurality of workheads comprised in the railroad chassis to position the blowing tubes at the first location;

rotating one or more of the blowing tubes relative to the workheads in response to a signal received from the computing system; and blowing, using an air compressor comprised in the railroad chassis, an amount of compressed air through the one or more blowing tubes to dispense the amount of ballast stones into the bed of ballast stones underneath the rail at the first location.

10. The method of claim 9, further comprising:

collecting, using one or more sensors, track profile data associated with a section of the railroad track corresponding to the first location;

determining, using the computing system comprised in the railroad chassis, a track profile of the section of the railroad track based on the collected track profile data; and determining, using the computing system, the optimal height of the rails of the railroad track at the first location based on the determined track profile.

11. The method of claim 9, wherein independently positioning the one or more workheads comprises lowering the one or more blowing tubes at least partially into the bed of ballast stones.

12. The method of claim 9, wherein the one or more workheads are independently positioned using one or more independent cylinders comprised in the railroad chassis.

13. The method of claim 9, wherein the one or more workheads are independently positioned using one or more third point lifting arms comprised in the railroad chassis.

14. The method of claim 9, further comprising:

distributing, from a supply of ballast stones comprised in the railroad chassis, the determined amount of ballast stones to the one or more workheads.

15. The method of claim 9, wherein the amount of compressed air is determined by the computing system based on the determined amount of ballast stones to be dispensed into the bed of ballast stones underneath the rail tie.

16. The method of claim 9, wherein the first location in the railroad track is a railroad frog.

17. A railroad chassis comprising:

a supply of ballast stones disposed on the railroad chassis;

at least one air compressor coupled to the railroad chassis; and a plurality of workheads coupled to the railroad chassis, wherein each workhead is independently operable, wherein each workhead is coupled to a blowing tube via a housing, and wherein the blowing tube is independently operable and configured to dispense ballast stones from the supply of ballast stones into a bed of ballast stones underlying a rail tie of a railroad track, and wherein a motor is disposed in the housing and is operable to rotate the blowing tube relative to the workhead based on a signal received from a computing system associated with the railroad chassis.

* * * * *